US011401578B2

(12) United States Patent
Terekhov et al.

(10) Patent No.: US 11,401,578 B2
(45) Date of Patent: Aug. 2, 2022

(54) EXTRACTION METHODS FROM REFRACTORY ORES

(71) Applicant: TCM Research Ltd., Dublin (IE)

(72) Inventors: Dmitri S. Terekhov, Ontario (CA); Colwyn S. van der Linde, Boksburg (ZA)

(73) Assignee: TCM RESEARCH LTD., Dublin (IE)

( * ) Notice: Subject to any disclaimer, the term of this patent is extended or adjusted under 35 U.S.C. 154(b) by 561 days.

(21) Appl. No.: 16/349,862

(22) PCT Filed: Nov. 10, 2017

(86) PCT No.: PCT/EP2017/078854
§ 371 (c)(1),
(2) Date: May 14, 2019

(87) PCT Pub. No.: WO2018/091361
PCT Pub. Date: May 24, 2018

(65) Prior Publication Data

US 2020/0056260 A1 Feb. 20, 2020

Related U.S. Application Data

(60) Provisional application No. 62/422,164, filed on Nov. 15, 2016.

(51) Int. Cl.
*C22B 1/10* (2006.01)
*C22B 11/02* (2006.01)
(Continued)

(52) U.S. Cl.
CPC ..... *C22B 1/10* (2013.01); *C22B 11/028* (2013.01); *C22B 13/025* (2013.01); *C22B 15/00* (2013.01); *C22B 19/04* (2013.01)

(58) Field of Classification Search
CPC ..... C22B 1/10; C22B 11/028; C22B 13/025; C22B 15/00; C22B 19/04
(Continued)

(56) References Cited

U.S. PATENT DOCUMENTS 3,499,754 A 3/1970 Colombo et al.
3,649,245 A 3/1972 Colombo et al.
(Continued)

FOREIGN PATENT DOCUMENTS

EP 0508542 A3 4/1992
WO 9312842 A1 7/1993
WO WO-9312842 A1 * 7/1993 ..... B01D 53/64

OTHER PUBLICATIONS

Engel, L. et al., "Recovery of Fumes from Chloride Volatilization of Gold", Report of Investigations 4582, pp. 1-14, Nov. 1949.

*Primary Examiner* — Brian D Walck
*Assistant Examiner* — Danielle Carda
(74) *Attorney, Agent, or Firm* — Greer, Burns & Crain, Ltd.

(57) ABSTRACT

A method for extracting and separating Gold, Silver, Copper, Zinc and/or Lead from an Arsenic-containing ore, concentrate or tailings characterized in that the extraction is carried by roasting in the presence of a calcium-containing material and at least one of an alkali metal halide and alkaline metal halide. In the method, Arsenic remains immobilized in the extraction residue.

14 Claims, 1 Drawing Sheet

(51) Int. Cl.
*C22B 13/02* (2006.01)
*C22B 15/00* (2006.01)
*C22B 19/04* (2006.01)

(58) Field of Classification Search
USPC ..... 75/410
See application file for complete search history.

(56) References Cited

U.S. PATENT DOCUMENTS

| | | | | |
|---|---|---|---|---|
| 3,758,293 | A | 9/1973 | Viviani et al. | |
| 4,092,152 | A | 5/1978 | Borbely | |
| 4,259,106 | A | 3/1981 | Aaltonen et al. | |
| 4,353,740 | A | 10/1982 | Dunn | |
| 4,642,133 | A | 2/1987 | Makinen et al. | |
| 6,482,373 | B1 * | 11/2002 | Hannaford | C22B 1/02 423/27 |

* cited by examiner

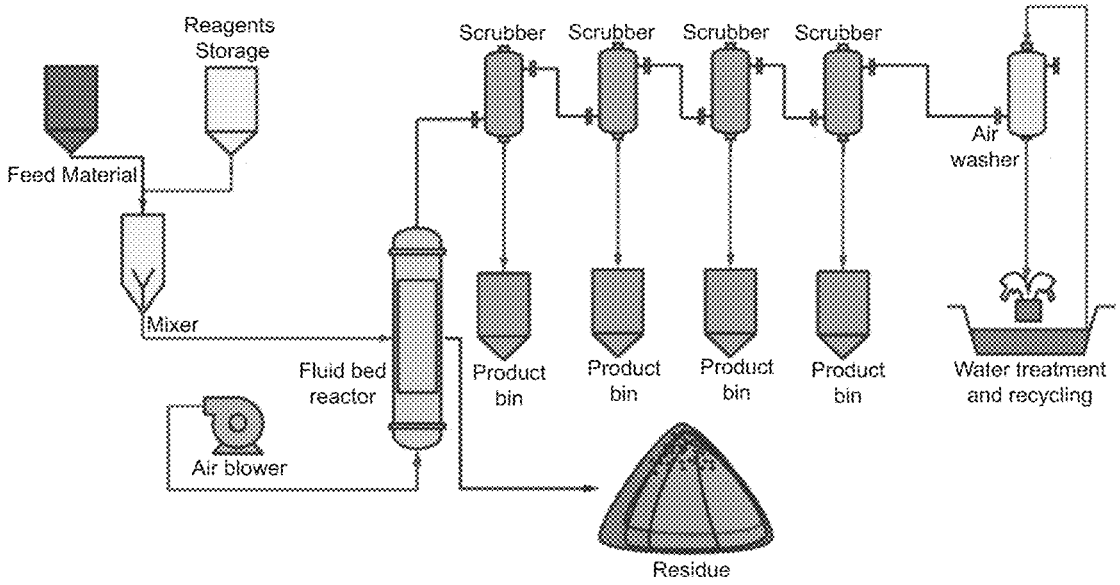
Reagents
Storage
Feed Material
Mixer
Fluid bed
reactor
Air blower
Scrubber
Scrubber
Scrubber
Scrubber
Product
bin
Product
bin
Product
bin
Product
bin
Air
washer
Water treatment
and recycling
Residue

EXTRACTION METHODS FROM REFRACTORY ORES

CROSS-REFERENCE TO RELATED APPLICATIONS

This application is the U.S. National phase application corresponding to PCT/EP2017/078854 which was assigned an international filing date of Nov. 10, 2017 which claims a benefit of priority from U.S. Provisional Patent Application 62/422,164 filed on Nov. 15, 2016, the entire disclosures of which are incorporated herein by reference.

TECHNICAL FIELD

The present invention relates to a process for extraction and separation of gold, silver and other metals from refractory ores, concentrates and tailings with minimum removal of arsenic.

BACKGROUND

In refractory gold ores, concentrates and tailings, gold is usually locked up in siliceous, carbonaceous, sulphide and arsenosulphide compounds. This creates various difficulties in gold extraction and recovery. A pre-treatment oxidation step is required to liberate gold and to facilitate the extraction of gold utilizing hydrometallurgical, biometallurgical or pyrometallurgical processes. During the pyrometallurgical pre-treatment process, sulphur and arsenic are removed in the form of volatile oxides. The disposal of such oxides creates an environmental concern and increases the cost of gold production.

U.S. Pat. No. 3,499,754 describes the purification of pyrite cinders by reductive roasting and chlorination with chlorine gas. The pyrite cinders were reduced to magnetite at a temperature between 600 and 850° C., and then chlorinated with chlorine and air at a temperature between 650 and 950° C. in a fluid-bed reactor. The volatile chlorides of Copper, Zinc, Lead, Gold, Silver, Nickel, Cobalt, Cadmium and Manganese were removed and scrubbed via a wet capture method. The solution was subjected to hydrometallurgical treatment to recover Copper, Gold, Silver and other metals. Sulfur and Arsenic were also removed, and purified hematite was cleaned from arsenic and other contamination. The level of arsenic was reported at below 0.02%.

Similarly, U.S. Pat. No. 3,649,245 describes a process of purification of pyrite and pyrrhotite from nonferrous metals, Sulphur and Arsenic. In this patent, heating and reduction of feed material was carried out in a fluid bed reactor in the presence of a small amount of Hydrochloric Acid or Chlorine gas. Arsenic was removed in the form of oxide or chloride together with Sulphur and nonferrous metals. The patent also describes some volatilization of iron (0.64%). The reaction temperatures ranged from 650 to 1000° C. with retention time from 20 to 150 minutes. Hydrochloric Acid was calculated to extract volatile chlorides as well as to bond Calcium and Barium oxides. The product was not analyzed for the presence of chlorine and therefore, it is unclear if Calcium Chloride or Barium Chloride were present.

U.S. Pat. No. 3,758,293 describes a slightly different procedure were Chlorine gas was used as a chlorinating agent in the presence of small amounts of oxygen of 0.5-0.8%. The temperature of the reaction was 950° C. and the reaction time was 60 minutes. The patent also mentions small amounts of volatilized iron in the form of Iron (II) Chloride. Calcium and Barium oxides were present in the feed material and were claimed to be responsible for partial bounding of Arsenic and Sulphur in the feed. The product had very low concentrations of Arsenic and Sulphur, indicating that any compounds of Calcium and Barium with Arsenic and Sulphur were decomposed during the process.

U.S. Pat. No. 4,259,106 uses a similar two-step process with Calcium Chloride as a chlorinating agent. First, the feed material was roasted to remove the bulk of the Sulphur and Arsenic and to produce an oxide melt. This was followed by addition of liquid Calcium Chloride to produce volatile metal chlorides. Most of the volatile metal chlorides were concentrated in a chloride dust. No description of separation of metals from chloride dust was provided. Lime was added in order to lower the melting point of the chloride melt to 1200-1300° C. The roasting temperature was 1250° C., and the chlorination temperature was up to 1500° C. The product was free of Arsenic, Sulphur, Lead, Zinc, Copper, Gold and Silver.

A similar two-step process is described in U.S. Pat. No. 4,642,133. Several metal chlorides were used as chlorinating agents, including Magnesium Chloride. The Chloride dust contained Lead, Zinc, Copper, Gold, Silver, Arsenic and some Sulphur.

U.S. Pat. No. 4,092,152 demonstrates separation of Cadmium, Bismuth, Rhenium, Lead, Molybdenum, Tin, Antimony, Zinc, and Arsenic from Copper, Silver, Cobalt, Iron, Nickel and Gold by roasting in the presence of Chlorine gas. An oxygen level was maintained between 2 and 20% to achieve extraction. The outgas was treated with Sodium Hydroxide scrubbing solution.

Gold could also be separated from ore by high temperature roasting and chlorination at 350° C. with a chloride (U.S. Pat. No. 4,353,740). The vapours were passed though a chloride melt to recover Gold. Silver was recovered by ammonia leach of the residue.

One of the most difficult parts of the chlorination process is recovery of volatile metal chlorides. Metal chlorides have been scrubbed in an electrostatic precipitator and/or by passing the vapours through water and/or reagents. The produced chloride vapours are very difficult to wet. This leads to an incomplete recovery of extracted metals. In the "Bureau of mines report of investigation 4582" published by A. L. Angel and H. J. Heinen described a method of wet scrubbing of chloride fumes. To achieve high yields, different reagents were added to the scrubbing solution including Sodium Sulphide, Sodium Thiosulphate, Thiourea and mixtures of different chlorides. It was possible to achieve high yields of recovery using combinations of sulfur and chloride compound solutions.

In all the above processes the roasting and chlorination steps are used to remove volatile metal chlorides together with Arsenic and Sulphur, with wet capture of volatile chlorides and separation is subsequently performed by hydrometallurgical methods.

SUMMARY

This disclosure provides a process for extracting Gold, Silver, Copper, Zinc and/or Lead from an Arsenic containing ores, concentrates and/or tailings. In this process, Arsenic remains immobilized in a solid extraction residue and the step of pre-treatment in which Arsenic is removed as a volatile oxide is omitted.

The present disclosure provides a method for extracting at least one metal from an Arsenic-containing ore, concentrate or tailings, the method comprising:

mixing the ore, concentrate or tailings with a calcium-containing material and at least one from an alkali metal halide and alkaline metal halide;

heating the mixture in the presence of air or oxygen, and thereby producing metal-containing volatile complexes and a solid residue comprising immobilized Arsenic;

condensing the volatile complexes in a scrubber containing at least one dry sorbent bed, and thereby producing a metal-loaded sorbent bed;

recovering the metal from the metal-loaded sorbent bed; and disposing of the residue containing immobilized Arsenic.

The metal may be Gold, Silver, Copper, Zinc, Lead, or any mixture thereof. If a mixture of metals is extracted, each of the metals may be condensed into a separate sorbent bed.

The calcium-containing material may comprise, contain, consist essentially of or consist of calcium carbonate, calcium chloride, calcium phosphate, calcium sulfate, calcium sulfide, calcium hydroxide, calcium oxide, and any mixture thereof. The calcium-containing material may be selected from lime, limestone, calcite, dolomite or any mixture thereof.

Suitable sorbents include alumina, zeolite, silica, aluminum oxide, quartz, or any mixture thereof. Alumina is an oxide of aluminum, occurring in nature as various minerals including bauxite and corundum. Zeolites are microporous, aluminosilicate minerals. Silica is silicon dioxide, most commonly found in nature as quartz.

Lime is one of the preferred calcium-containing materials. The calcium-containing material may be also calcium chloride and/or calcium hydroxide.

Alumina is one of the preferred sorbents.

A preferred at least one from an alkali metal halide and alkaline metal halide is sodium chloride, calcium chloride or any combination thereof.

The method may be conducted to extract silver from an Arsenic containing ore, concentrate or tailings. The method may be also conducted to extract Gold from an Arsenic containing ore, concentrate or tailings. The method may be also conducted to extract Copper, Lead and/or Zinc from an Arsenic containing ore, concentrate or tailings.

The heating step in the method may be performed in a roasting device such as a rotary kiln, drum kiln, fluidized bed reactor and entrained flow reactor. A temperature in the range from 850° C. to 1200° C. is particularly preferred for the heating step. The heating step may be also performed under a reduced pressure in the range from a 0.5% to 10% decrease from the standard sea-level atmospheric pressure of 101.325 kilopascals.

In further aspects, the method can be used for extracting a metal from an ore, concentrate or tailings and also for separating the metal from other metals. If the ore, concentrate or tailings comprises a mixture of at least two compounds comprising metals selected from Gold, Silver, Copper, Zinc and Lead, the volatile complexes produced in the heating step may be separated from each other into fractions containing predominantly individual metals by condensation into a set of sorbent beds.

BRIEF DESCRIPTION OF THE DRAWINGS

FIG. 1 represents a block diagram of the present process for extraction and separation of metals from refractory ores, concentrate or tailings.

DETAILED DESCRIPTION

The present disclosure provides a method for processing ores, concentrates and/or tailings which comprise Arsenic and at least one of the following metals: Gold, Silver, Copper, Zinc and/or Lead. In an ore, concentrate and/or tailings, Gold, Silver, Copper, Zinc and/or Lead is typically present in a form of a compound, including a siliceous, carbonaceous, sulphide and/or arsenosulphide compound. A feed material comprising the ore, concentrate and/or tailings may be mixed with a calcium-containing material and at least one from an alkali metal halide and alkaline metal halide. The feed material may be optionally crushed to a particle size of 20 to 200 mesh prior to mixing.

An alkali metal halide has a general formula $M_aX$, wherein $M_a$ is an alkali metal and X is a halogen. Examples of suitable alkali metal halides include sodium chloride (NaCl), potassium chloride (KCl) and lithium chloride (LiCl).

An alkaline metal halide has a general formula $MX_2$, wherein M is a metal of group 2 of the Periodic table and X is a halogen. Examples of suitable alkaline metal halides include calcium chloride ($CaCl_2$), magnesium chloride ($MgCl_2$), beryllium chloride ($BeCl_2$) and barium chloride ($BaCl_2$).

Suitable calcium-containing materials include, but are not limited to, calcium carbonate, calcium chloride, calcium phosphate, calcium sulfate, calcium sulfide, calcium hydroxide, calcium oxide, and any mixture thereof. A calcium-containing material may be at least one from lime, limestone, calcite and/or dolomite. Lime is a calcium-containing inorganic mineral in which calcium is mostly in a form of carbonate, oxide, and hydroxide. Limestone is a sedimentary rock which predominantly comprises calcium-bearing carbonate minerals—calcite and dolomite. Calcite is chemically calcium carbonate. Dolomite is chemically calcium-magnesium carbonate.

The ore, concentrate and/or tailings is mixed with a calcium-containing material and at least one from an alkali metal halide and alkaline metal halide. The mixture is then roasted in the presence of air or oxygen. The term "roasting" is used interchangeably with the term "heating."

The roasting is performed in a reactor where the air or oxygen is passed through the mixture. A reactor may have a fluid bed. The reactor may be a kiln. The roasting temperature is in the range from 850° C. to 1200° C. The roasting can be performed under a slightly decreased pressure. The pressure can be decreased by 2% from standard atmospheric pressure, and preferably from 0.5% to 10% from the standard-sea level pressure equal to one standard atmosphere (atm) or 101.325 kilopascals.

Volatile metal chloride complexes of Gold, Silver, Copper, Zinc and/or Lead produced in the heating reaction are absorbed in a scrubber containing at least one or more dry sorbent beds which become predominantly loaded with one of the following metals: Gold, Silver, Copper, Zinc and Lead. Suitable sorbent materials include, but are not limited to, aluminum oxide, alumina, zeolite, silica and quartz. Alumina is an oxide of aluminum occurring in nature as a mineral including such as bauxite or corundum. Zeolites are microporous aluminosilicate minerals. Silica is a silicon dioxide. Quartz is a mineral composed of silicon and oxygen atoms.

In the present method, metals, such as Gold, Silver, Copper, Zinc and Lead, are removed from the loaded sorbent beds by washing. The sorbent material is dried and recycled. The present method may be used to separate each of Gold, Silver, Copper, Zinc and Lead from a mixture.

After extraction of metals, the residual material is removed from the extraction reactor. The residual material contains most of the Arsenic in immobilized form and can be disposed of.

As shown in FIG. 1, which is a block diagram of the present process for extraction and separation of metals, a feed material and reagents are mixed in a mixer and continuously fed to an extraction reactor which may comprise a roasting device, selected from the group of rotary kilns, drum kilns, fluidized bed reactors and entrained flow reactors. The feed material may be an ore, concentrate or tailings. The feed material may comprise at least one of Gold, Silver, Copper, Zinc and Lead. The feed material may comprise a mixture of any two or more from Gold, Silver, Copper, Zinc and Lead. One of the technical advantages of the present method is it can be used for recovery and simultaneously separation of Gold, Silver, Copper, Zinc and Lead from a mixture comprising two or more of these metals.

As shown in FIG. 1, the resulting mixture of the feed material is heated in an extraction reactor to a reaction temperature in the range from 850° C. to 1200° C. in a stream of air provided by an air blower. This reaction produces a volatile mixture of metal chloride complexes which are collected in a number of scrubbers where the metals are selectively absorbed on sorbents. Chloride-depleted spent gas mixture is washed by water in an air washer. Arsenic containing solid residue is continuously removed from the extraction reactor and is disposed of.

The present method provides a recovery of the metals with a high yield recovery of Gold, Silver, Copper, Zinc and/or Lead. Importantly, nearly all Arsenic (at least 80% or higher) remains in the solid residue in an extraction reactor and is not converted into a volatile compound.

EXAMPLE 1

A concentrate contained 8.0 ppm of Gold, 118.5 ppm of Silver, 0.82% of Arsenic, 0.11% of Copper, 0.14% of Zinc, 0.11% of Lead, 31.1% of Iron Oxide ($Fe_2O_3$) and 35.5% of Silica ($SiO_2$) was mixed with 6.5% of Sodium Chloride and 13% of Calcium Hydroxide. The resulting mixture was heated up to 1050° C. in a stream of air under a slightly reduced pressure. The released metal chloride fumes were adsorbed onto several aluminosilicate sorbent beds. After 30 min, the residue was cooled down. The residual material composition was 0.4 ppm Gold (94% yield), 2.5 ppm Silver (98% yield), 58 ppm Copper (95% yield), 57 ppm Lead (95% yield) and 0.059% of Zinc (56% yield). The residue contained 30.1% of Iron Oxide ($Fe_2O_3$) and 0.77% of Arsenic. Near total Iron and Arsenic remained in the residue. The total weight loss of material during metal extraction was 15% of mostly water. No chlorine was found in the residue. The first sorbent bed contained mostly Zinc, the next sorbent bed contained Lead and Copper, and the followed by Gold and Silver.

EXAMPLE 2

An ore (3.9 ppm Gold, 42.9 ppm Silver, 398 ppm Copper, 494 ppm of Arsenic, 4.47% of Iron Oxide ($Fe_2O_3$)) was mixed with 13% of Sodium Chloride and 6.5% of Calcium Hydroxide and heated to 1050° C. in a stream of air under slightly reduced pressure. The released metal chloride fumes were absorbed onto several alumina sorbent beds. After 30 min, the residue was cooled down. The residual material contained 0.28 ppm of Gold (95% yield), 26 ppm of Copper (93% yield). The Silver concentration in the residue was below the detection limit of the analytical method used. The concentration of Arsenic was 354 ppm with 81% of Arsenic remaining in the residue. The removed Arsenic was collected in the first sorbent bed together with about 10% of the Copper. Gold and Silver were absorbed in the third sorbent bed with only a small amount in the fourth one. The total weight loss of material during metal extraction was 11% of mostly water. No chlorine was found in the solid residue.

EXAMPLE 3

A concentrate (153 ppm Gold, 889 ppm Silver, 223 ppm Copper, 321 ppm of Arsenic, 3.0% of Iron Oxide ($Fe_2O_3$), 0.60% of Lead and 0.45% Zinc) was mixed with 10% of Calcium Chloride ($CaCl_2$) and heated to 1050° C. in a stream of air under slightly reduced pressure. The released metal chloride fumes were absorbed onto several alumina sorbent beds. The residual material contained 1.37 ppm of Gold (99% yield), 37 ppm of Silver (96% yield), 32 ppm of Copper (89% yield), 14 ppm of Lead (99% yield) and 73 ppm of Zinc (99% yield).

The concentration of Arsenic was 318 ppm with 99% of Arsenic remaining in the residue. Most of the Gold and Silver were absorbed on the second sorbent bed, but with significant amounts on the first and the third absorbent beds with only a small amount in the fourth one. The distribution of Zinc and Lead was the same as Gold and Silver with no separation between extracted metals. The total weight loss of material during metal extraction was 19% of mostly water. No chlorine was found in the residue.

EXAMPLE 4

A concentrate (103 ppm Gold, 398 ppm Silver, 0.35% Copper, 241 ppm of Arsenic, 3.0% of Iron Oxide ($Fe_2O_3$), 0.50% Lead, 0.46% Zinc, 0.11% of Uranium was mixed with 6.5% of Sodium Chloride (NaCl) and 6.5% of Calcium Chloride ($CaCl_2$) and heated to 1050° C. in a stream of air under slightly reduced pressure. The realised metal chloride fumes were absorbed onto several alumina sorbent beds. After 30 min, the residue was cooled down. The residual material contained 2.4 ppm of Gold (98% yield), 18.9 ppm of Silver (95% yield), 111 ppm of Copper (97% yield), undetected amount of Lead (99% yield) and 46 ppm of Zinc (99% yield). The concentration of Arsenic and Uranium in the sorbent beds was below the detection limit of the analytical method employed, with near total retention of Arsenic and Uranium in the residue. The distribution of Zinc, Lead, Copper was the same as Gold and Silver with no separation between the extracted metals. The total weight loss of material during metal extraction was 12% of mostly water. No chlorine was found in the residue.

EXAMPLE 5

A Tailing (1.57 ppm Gold, 1150 ppm Copper, 1980 ppm of Arsenic, 49% Iron Oxide ($Fe_2O_3$), 266 ppm of Lead, 413 ppm Zinc, 92 ppm of Uranium) was mixed with 10% of Sodium Chloride (NaCl) and heated to 1050° C. in a stream of air under slightly reduced pressure. The released metal chloride fumes were absorbed onto several alumina sorbent beds. After 30 min, the residue was cooled down. The residual material contained 0.16 ppm of Gold (90% yield), 8 ppm of Copper (99% yield), 3 ppm of Lead (99% yield) and 27 ppm of Zinc (93% yield). The concentration of Arsenic and Uranium in the sorbent beds was below the analytical detection limit with 100% of Arsenic and Uranium remaining in the residue. The first sorbent bed contained mostly Zinc followed by Lead and Copper, with Gold concentrated in the second sorbent bed. The total weight loss of material during metal extraction was 11% of mostly water. No chlorine was found in the residue.

What is claimed is:

1. A method for extracting at least one metal from an Arsenic-containing ore, concentrate or tailings, the method comprising:

mixing a mixture comprising the ore, concentrate or tailings with a calcium-containing material and at least one from an alkali metal halide and alkaline metal halide;

heating the mixture in the presence of air or oxygen, and thereby producing metal-containing volatile complexes and a solid residue comprising immobilized arsenic, wherein the heating step is performed under a reduced pressure in the range from a 0.5% to 10% decrease from the standard sea-level atmospheric pressure of 101.325 kilopascals;

condensing the metal-containing volatile complexes in a scrubber containing at least one dry sorbent bed, and thereby producing a metal-loaded sorbent bed;

recovering the metal from the metal-loaded sorbent bed; and disposing of the solid residue containing immobilized Arsenic.

2. The method of claim 1, wherein the at least one metal is Gold, Silver, Copper, Zinc, Lead, or any mixture thereof; and wherein if a mixture of metals is extracted, each of the metals is condensed into a separate dry sorbent bed.

3. The method of claim 1, wherein the calcium-containing material is selected from calcium carbonate, calcium chloride, calcium phosphate, calcium sulfate, calcium sulfide, calcium hydroxide, calcium oxide, and any mixture thereof.

4. The method of claim 1, wherein the calcium-containing material is selected from lime, limestone, calcite, dolomite or any mixture thereof.

5. The method of claim 1, wherein the ore, concentrate or tailings is an Arsenic Silver containing ore, concentrate or tailings.

6. The method of claim 1, wherein the ore, concentrate or tailings comprises an Arsenic Gold containing ore, concentrate or tailings.

7. The method of claim 1, wherein the heating step is performed in a fluid bed reactor.

8. The method of claim 1, wherein the heating step is performed at a temperature in the range from 850° C. to 1200° C.

9. The method of claim 1, wherein the dry sorbent bed is a material selected from alumina, zeolite, silica, aluminum oxide, quartz, or any mixture thereof.

10. The method of claim 1, wherein the ore, concentrate or tailings comprises a mixture of at least two compounds comprising metals selected from Gold, Silver, Copper, Zinc and Lead, and the heating step produces at least two of the Gold, Silver, Copper, Zinc and/or Lead metal-containing volatile complexes, and wherein the metals are separated from each other into fractions containing predominantly individual metals by condensation into separate dry sorbent beds.

11. The method of claim 1, wherein the calcium-containing material is lime.

12. The method of claim 1, wherein the calcium-containing material is calcium chloride and/or calcium hydroxide.

13. The method of claim 1, wherein the dry sorbent bed is alumina.

14. The method of claim 1, wherein the at least one from the alkali metal halide and alkaline metal halide is sodium chloride, calcium chloride or any combination thereof.

* * * * *